United States Patent [19]

Bewer et al.

[11] 4,431,686

[45] Feb. 14, 1984

[54] METHOD FOR COATING A POROUS ELECTRODE

[75] Inventors: Günter Bewer, Westendorf; Hubertus Härle, Augsburg; Dieter Lieberoth, Meitingen, all of Fed. Rep. of Germany

[73] Assignee: Sigri Elektrographit GmbH, Meitingen bei Augsburg, Fed. Rep. of Germany

[21] Appl. No.: 413,961

[22] Filed: Sep. 1, 1982

Related U.S. Application Data

[63] Continuation of Ser. No. 226,938, Jan. 21, 1981, abandoned.

[30] Foreign Application Priority Data

Feb. 5, 1980 [DE] Fed. Rep. of Germany ..... 3004080

[51] Int. Cl.[3] ..... B05D 5/12; C25B 11/03

[52] U.S. Cl. ..... 427/125; 427/126.5; 427/226; 427/243; 427/247; 427/380; 204/284; 204/290 R; 204/290 F

[58] Field of Search ..... 427/126.5, 125, 226, 427/247, 243, 380; 204/290 F, 290 R, 284

[56] References Cited

U.S. PATENT DOCUMENTS

| | | | |
|---|---|---|---|
| Re. 28,820 | 5/1976 | Beer | 427/126.5 |
| 3,562,008 | 2/1971 | Martinsons | 427/126.5 |
| 3,684,543 | 8/1972 | de Nora et al. | 427/126.5 |
| 3,924,025 | 12/1975 | Kolb et al. | 427/126.5 |
| 4,070,504 | 1/1978 | Bianchi et al. | 427/126.5 |
| 4,120,772 | 10/1978 | Kadija | 204/290 F |

*Primary Examiner*—James R. Hoffman
*Assistant Examiner*—Richard Bueker
*Attorney, Agent, or Firm*—Herbert L. Lerner; Laurence A. Greenberg

[57] ABSTRACT

Coating a porous electrode for electrochemical processes with an activation layer which covers the electrode surface at least in part and contains metals or compounds of metals of the platinum group by:

(a) coating with a suspension containing particles of a metal of the platinum group and a dispersion agent in which the particles will dissolve at an elevated temperature, (b) heating the coated electrode to dissolve the particles, (c) heating the electrode to evaporate the agent, decompose the compound and deposit a layer of the metal of the platinum group on the electrode surface, (d) repeating the cycle to obtain a layer of desired thickness, (e) heating the electrode in an oxygen-containing atmosphere to a temperature between 400° and 600° C.

8 Claims, No Drawings

METHOD FOR COATING A POROUS ELECTRODE

This is a continuation, of application Ser. No. 226,938, filed Jan. 21, 1981, now abandoned.

BACKGROUND OF THE INVENTION

1. Field of the Invention

The invention relates to a method for coating a porous electrode for electrochemical processes with an activation layer which covers the electrode surface at least in part and contains metals or compounds of metals of the platinum group.

2. Description of the Prior Art

For activating electrodes for electrochemical processes, for instance, of anodes for the chlorine-alkali electrolysis, of a material which is resistant to the products of the electrolysis and forms a passivating layer under the conditions of the electrolysis, numerous methods have become known, the purpose of which is essentially to anchor a platinum metal or compounds containing platinum metals mechanically firmly on the electrode or the electrode core in an electrochemically effective degree of dispersion. It is known, for instance, from German Published Prosecuted Application No. 11 55 762 to coat degreased and pickled titanium sheets by electroplating with a platinum metal and to heat the sheets in a first thermal cycle in an inert atmosphere and in a second cycle in an oxidizing atmosphere to a temperature of 800° C. With this treatment, a firmly adhering activation layer and at the same time improved protection of the electrode material is obtained by reaction of the titanium core in rutile which core is exposed in the pores of the activation layer which is a thin barrier layer of titanium oxide. This and other coating methods that have become known are not as suitable, however, for porous electrodes, for instance, for sintered electrodes according to German Published Non-Prosecuted Application No. 23 05 175 or electrodes of titanium suboxide according to German Published Prosecuted Application No. 24 05 010. The adhesion of the activation layers is particularly favorable with porous electrodes and for many electrochemical processes, the large surface of the electrode is an advantage. However, in coating the electrode with an activation layer, losses of activating agent occur if the known methods are used, since the platinum metals or platinum metal compounds are in part also deposited in the pores of the electrode which are away from the surface, and the surfaces of which do not participate in the electrochemical reactions. The loss is particularly great if the activating agent is precipitated from solutions and is not so great if the activation layer is electrodeposited. Electrodeposited layers, on the other hand, are less suitable because of their dense structure. It has also been proposed (for instance, German Published Prosecuted Application No. 16 71 422) to apply the metals or metal compounds to the electrode surface from finely dispersed suspensions. Because of the great difficulty in obtaining uniform distribution and good adhesion of the applied activating substances, the above-described coating methods are preferred on a technical scale.

SUMMARY OF THE INVENTION

An object of the invention is to provide a coating method for porous electrodes which gives highly effective activation layers with small amounts of platinum metals and does not have the above-described disadvantages, especially the relatively large requirement of activating agents.

With the foregoing and other objects in view, there is provided in accordance with the invention a method for coating a porous electrode for electrochemical processes with an activation layer which covers the electrode surface at least in part and contains metals and compounds of metals of the platinum group, which comprises coating the electrode surface to be covered by an activation layer with a suspension containing particles of a compound of a metal of the platinum group and a dispersion agent in which the particles will dissolve at an elevated temperature, heating the coated electrode to an elevated temperature to dissolve the dispersed phase of the suspension in the dispersion agent, heating the electrode to deposit a layer of the metal of the platinum group on the electrode surface by evaporating the agent and decomposing the compound by heating the electrode to a temperature between 250° and 350° C.; repeating the cycle a plurality of times to obtain a layer of desired thickness; and then heating the electrode in an oxygen-containing atmosphere to a temperature between 400° and 600° C.

Other features which are considered as characteristic for the invention are set forth in the appended claims.

Although the invention is illustrated and described herein as embodied in a method for coating a porous electrode, it is nevertheless not intended to be limited to the details shown, since various modification may be made therein without departing from the spirit of the invention and within the scope and range of equivalents of the claims.

The invention, however, together with additional objects and advantages thereof will be best understood from the following description.

DETAILED DESCRIPTION OF THE INVENTION

According to the invention, the electrode surface is coated with a suspension coating fine-grain compounds of metals of the platinum group and a dispersion agent dissolving the compounds at elevated temperatures. The dispersed phase of the suspension is dissolved in the dispersion agent by heating the coated electrode; is deposited on the electrode surface by evaporating the agent and is decomposed by heating the electrode to a temperature between 250° and 350° C. The cycle is repeated several times and the electrode is then heated in an oxygen-containing atmosphere to a temperature between 400° and 600° C.

The invention is based on the discovery that particles dispersed in a suspension cannot get into pores which are accessible via narrow tubes or canals, while the dispersion agent fills these pores. The particles with a diameter corresponding to the pore diameter block the tubes or canals preventing solids from penetrating. Particles of larger diameter cannot enter the pores and particles of smaller diameter because the dispersion agent tends to retard their mobility together with other particles of different size, tend to cause the particles to pile up at the pore entrance and block passage of solids therein. If the electrode is heated after the coating, the dispersion agent leaves the pores and dissolves the particles concentrated at the pore entrance because the compounds of the platinum group used according to the invention are increasingly soluble with increasing temperatures. The solution which is present in a thin layer has relatively good viscosity and spreads uniformly across the outer electrode surface and the surface of larger pores accessible from the outer surface without penetrating into narrow canals or tube pores. The compounds which are deposited with uniform layer thickness through evaporation of the solvent, are then decomposed by heating the electrode to a temperature between 250° and 350° C., in the process of which a ragged metallic activation layer is formed which has a large specific surface. A layer thickness of about 1 μm ordinarily required for technical purposes is obtained by repeating the coating cycle several times. Finally, the invention provides for heating the coated electrode in an oxidizing atmosphere of preferably air, to a temperature between 400° and 600° C. The purpose of the heat treatment is primarily passivating the electrode surface exposed in pores of the activation layer, and anchoring the activation layer on this surface. Partial oxidation of the platinum metals contained in the activation layer is not detrimental since the growth of the metal crystals is inhibited and finely dispersed layers exhibit greater electrochemical activity. The treatment temperature should, therefore, not be less nor more than the temperature interval from 400° to 600° C. The heating time is advantageously 3 to 60 minutes and can be determined in detail readily by simple tests for each electrode material and each compound used as the activating agent.

According to one advantageous embodiment of the method according to the invention, compounds of non-platinum metals are dispersed in the dispersion agent in addition to compounds of metals of the platinum group. Suitable non-platinum metals are tantalum, zirconium, niobium, aluminum and especially, titanium. The activation layer then contains after the oxidizing treatment a finely dispersed mixture of platinum metals, oxides of platinum metals, and oxides of non-platinum metals. According to another advantageous embodiment of the invention, thermally decomposable complex compounds are used, which contain free acid, as compounds of metals of the platinum group and of non-platinum metals, especially compounds selected from the group consisting of oxalate, formate, tartrate, and citrate complexes of metals selected from the group consisting of ruthenium, rhodium, palladium, iridium, and platinum and analgous compounds of the non-platinum metals. The dispersion agent used according to the invention dissolves the complex compounds at elevated temperature; solutions are formed which etch especially the electrode surface and, particularly, passivating layers. Especially well suited for this purpose are water and optionally, aqueous oxalic acid solutions. With this method, the adhesion background is improved without the formation of corrosive and noxious vapors as when hydrochloric platinum metal chloride solutions are used.

All electrically conductive metals, alloys and compounds which are stable under the conditions of electrochemical processes are basically suited as electrodes. Passivating layer-forming metals such as titanium, tantalum, zirconium and niobium, and preferably electrodes which consist at least in part of titanium suboxide are used, for instance, as an anode for chlorine-alkali electrolysis. The electrodes according to the invention have a porosity of about 10 to 15% and are generally produced by sintering molded pieces of a metal powder or an oxide powder.

The advantages of the method according to the invention for preparing an activation layer on a porous electrode are substantially the following:

1. Only that part of the total surface is coated which participates in the electrochemical reactions,
2. the substances used are not corrosive and detrimental to health,
3. the activation layer produced has fine-grain structure and exhibits high electrochemical activity, and
4. the activation layer is firmly anchored in the porous electrode.

From this results better utilization of the expensive platinum metals, the availability of which is limited.

The invention will be further illustrated by way of the following examples:

EXAMPLE 1

4.14 parts by weight titanium powder with a grain size of less than 0.06 mm and 38.6 parts by weight rutile powder with a grain size of less than 0.01 mm were mixed after 5 parts by weight of a 2% aqueous polyvinyl-alcohol solution have been added in a mixer and rapidly mixed. The mixture was pressed with a pressure of about 50 bar in a forging press into molded parts. The molded parts were dried, heated in an argon atmosphere to 1250° C. and then comminuted in a jaw crusher and milled in a ball mill to a grain size of less than 0.06 mm. The brittle powder had the color of grey iron and had a composition of $TiO_{0.56}$.

To 100 parts by weight powder were added 5 parts by weight of a 10% solution of hard paraffin in toluol, followed by 5 minutes of mixing in a rotary mixer. The mixture was molded in a forging press with a pressure of 2 k bar to form sheet electrodes which were heated to 1250° C. in a pusher furnace in an argon atmosphere. The sintered electrode sheets, the porosity of which is approximately 16%, were coated with a 10% aqueous sludge of $H[Ru(C_2O_4)_2].2.5H_2O$ (prepared in accordance with O. E. Zviagintsev and S. M. Starostin, Zh. Neorgan, Khim. 2 (1957) 1281/8), first dried at room temperature and finally at 105° C. For decomposing the salt, the temperature was increased to 300° C. The cycle was repeated four times and a total quantity of rare metal of about 7 g $Ru/m^2$ was deposited. The coated electrode was heated to 500° C., the residence time at this temperature being five minutes.

The electrode sheet was then tested as an anode in an amalgam test cell. The conditions were:

| | |
|---|---|
| Current density | 20 $kA/m^2$ |
| Temperature approx. | 70° C. |
| Brine approx. | 300 g/l NaCl |

After predetermined time intervals, the anode potential was measured with a Luggin capillary against the saturated calomel electrode.

| Running time | Potential |
|---|---|
| 100 hours | 1.102 Volts |
| 300 | 1.115 |
| 500 | 1.112 |

EXAMPLE 2

In a die, 100 parts titanium sponge having a grain size of less than 2 mm were overlayed with 20 parts $TiO_{0.56}$ powder, the preparation of which is described in Example 1, and pressed with a pressure of about 2 k bar into composite sheets which were sintered as in Example 1. The titanium suboxide side of the sheets was coated with a sludge of 66 parts $H[Ru(C_2O_4)_2].2.5H_2O$ and 100 parts $Ti_2(C_2O_4)_3.10H_2O$ (prepared in accordance with A. Staehler, Ber. 38 (1905) 2619/29) in 1000 parts water in which 25 parts oxalic acid were dissolved. The heat treatment corresponded to Example 1 except for the oxidizing anneal at 550° C. and a holding time of 15 minutes.

The following potentials were measured:

| Running time | Potential |
|---|---|
| 100 hours | 1.109 Volts |
| 200 | 1.113 |
| 300 | 1.113 |

EXAMPLE 3

Composite sheets as in Example 2 were coated with a sludge of 66 parts $H_2[Ru(C_2O_4)_2].2.5H_2O$, 70 parts $H_2[Ir_2(C_2O_4)_3]$, and 100 parts $Ti_2(C_2O_4)_3.10H_2O$ in 1000 parts water and 50 parts oxalic acid, were annealed and the potentials were measured.

| Running time | Potential |
|---|---|
| 100 hours | 1.106 Volts |
| 200 | 1.112 |
| 300 | 1.110 |

We claim:

1. Method for coating a porous sintered electrode unimpregnated with a ceramic oxide without also coating the porous interior of the electrode, for electrochemical processes with an activation layer which covers the electrode surface at least in part and contains metals and compounds of metals of the platinum group, which comprises coating the porous electrode surface to be covered by an activation layer with a suspension containing dispersed particles of a compound of a metal of the platinum group in a dispersion agent in which the particles will dissolve at an elevated temperature, the particles of the compound of a metal of the platinum group having diameters larger than the pore diameters of the electrode permitting the dispersion agent only to enter the pores, heating the coated electrode to an elevated temperature to dissolve the dispersed particles of the suspension in the dispersion agent, heating the electrode to deposit a layer of the metal of the platinum group on the electrode surface by evaporating the agent and decomposing the compound by heating the electrode to a temperature between 250° and 350° C.; repeating the cycle a plurality of times to obtain a layer of desired thickness; and then heating the electrode in an oxygen-containing atmosphere to a temperature between 400° and 600° C.

2. Method according to claim 1, wherein a compound of a metal of the platinum group and a compound of a non-platinum metal are dispersed in the dispersion agent.

3. Method according to claim 1, wherein the solution formed by the dispersion agent at the elevated temperature with the compounds of metal of the platinum group has an etching effect on the electrode surface.

4. Method according to claim 1, wherein said compound is selected from the group consisting of oxalato, formato, tartrato and citrato complexes of at least one metal selected solely from the group consisting of ruthenium, rhodium, palladium, iridium and platinum.

5. Method according to claim 2, wherein said compound of a metal of the platinum group is selected from the group consisting of oxalato, formato, tartrato and citrato complexes of at least one metal selected solely from the group consisting of ruthenium, rhodium, palladium, iridinum and platinum.

6. Method according to claim 1 or claim 2 or claim 4 or claim 5, wherein water is the dispersion agent.

7. Method according to claim 1 or claim 2 or claim 4 or claim 5, wherein an aqueous solution of oxalic acid is the dispersion agent.

8. Method according to claim 1, wherein the electrode consists at least in part of titanium suboxide.

* * * * *